US011280052B1

(12) United States Patent
Jensrud

(10) Patent No.: US 11,280,052 B1
(45) Date of Patent: Mar. 22, 2022

(54) UNDERGROUND FUEL TANK INDICATOR FLAG

(71) Applicant: Troy Jensrud, River Falls, WI (US)

(72) Inventor: Troy Jensrud, River Falls, WI (US)

( * ) Notice: Subject to any disclaimer, the term of this patent is extended or adjusted under 35 U.S.C. 154(b) by 496 days.

(21) Appl. No.: 16/299,278

(22) Filed: Mar. 12, 2019

(51) Int. Cl.
*E01F 9/627* (2016.01)
*E01F 9/608* (2016.01)
*G09F 17/00* (2006.01)

(52) U.S. Cl.
CPC ..... *E01F 9/629* (2016.02); *E01F 9/608* (2016.02); *G09F 17/00* (2013.01); *G09F 2017/0066* (2013.01)

(58) Field of Classification Search
CPC ..... E01F 9/629; E01F 9/608; G09F 17/00; G09F 2017/0066
See application file for complete search history.

(56) References Cited

U.S. PATENT DOCUMENTS 1,828,892 A * 10/1931 Felton ..... E01F 9/627 116/173
2,165,704 A * 7/1939 Hood ..... E01F 9/627 40/608
2,336,150 A * 12/1943 Horvath ..... B64F 1/28 210/170.01
2,564,226 A * 8/1951 Norway ..... F17C 13/04 62/50.2
2,617,215 A 11/1952 Morris
3,204,355 A 9/1965 Whitman
3,838,661 A * 10/1974 Medley, Jr. ..... E01F 9/629 116/63 P
4,636,109 A * 1/1987 Clausen ..... E01F 9/627 116/63 P
D292,894 S 11/1987 Whitmer
4,806,046 A * 2/1989 Clark ..... A63C 19/062 40/608
4,971,477 A * 11/1990 Webb ..... B67D 7/78 405/154.1
5,040,478 A 8/1991 Hughes
5,072,940 A * 12/1991 Bailey ..... A63B 57/30 473/150
5,122,264 A * 6/1992 Mohr ..... B67D 7/76 137/234.6
5,205,236 A 4/1993 Hughes
5,207,175 A * 5/1993 Andonian ..... E01F 9/629 116/209

(Continued)

*Primary Examiner* — Nimeshkumar D Patel
*Assistant Examiner* — Tania Courson
(74) *Attorney, Agent, or Firm* — Kyle A. Fletcher, Esq.

(57) ABSTRACT

The underground fuel tank indicator flag may comprise a stanchion and a flag. The underground fuel tank indicator flag may mark the location of a filler port where a tanker truck would couple to an underground fuel tank to add fuel to the underground fuel tank. The underground fuel tank indicator flag may convey at least one attribute of the fuel in the underground fuel tank. As non-limiting examples, the attribute may indicate the fuel type, an octane rating, or a fuel blend. The underground fuel tank indicator flag may be resilient such that a vehicle could drive over the stanchion and the stanchion will restore itself to a vertical orientation when the vehicle is moved off of the underground fuel tank indicator flag. In some embodiments, the underground fuel tank indicator flag may utilize multiple colors on the flag and/or a second flag.

15 Claims, 5 Drawing Sheets

(56) References Cited

U.S. PATENT DOCUMENTS

| | | | | | |
|---|---|---|---|---|---|
| 5,215,033 | A * | 6/1993 | Gipp | A63C 19/062 | 116/173 |
| 5,257,652 | A * | 11/1993 | Lawrence | B60S 5/02 | 137/312 |
| 5,354,144 | A * | 10/1994 | Lizakowski | E01F 9/629 | 40/612 |
| 5,607,153 | A * | 3/1997 | Bailey | A63B 57/12 | 473/150 |
| 5,703,577 | A * | 12/1997 | Carter | G08G 1/095 | 248/158 |
| 5,908,262 | A * | 6/1999 | Ahn | E01F 9/675 | 404/9 |
| 5,911,192 | A | 6/1999 | Yap | | |
| 6,928,952 | B2 * | 8/2005 | Garcia | E01F 9/688 | 116/63 C |
| 6,945,731 | B1 * | 9/2005 | Vait | G09F 17/00 | 116/173 |
| 7,451,721 | B1 | 11/2008 | Garza | | |
| 7,849,617 | B2 * | 12/2010 | Intagliata | E01F 9/629 | 40/608 |
| 9,440,843 | B2 * | 9/2016 | Polzin | B67D 7/04 | |
| 9,580,877 | B2 | 2/2017 | Shin | | |
| 9,926,718 | B2 * | 3/2018 | Brodie | E01F 9/629 | |
| 10,022,611 | B2 * | 7/2018 | Oh | E01F 9/602 | |
| 2011/0293367 | A1 * | 12/2011 | Yeghiayan | E01F 9/619 | 404/10 |
| 2019/0169806 | A1 * | 6/2019 | Coursey | E01F 9/629 | |
| 2019/0242078 | A1 * | 8/2019 | Curley | H02G 1/00 | |

* cited by examiner

UNDERGROUND FUEL TANK INDICATOR FLAG

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

Field of the Invention

The present invention relates to the field of signaling devices, more specifically, an underground fuel tank indicator flag.

SUMMARY OF INVENTION

The underground fuel tank indicator flag may comprise a stanchion and a flag. The underground fuel tank indicator flag may mark the location of a filler port where a tanker truck would couple to an underground fuel tank to add fuel to the underground fuel tank. The underground fuel tank indicator flag may convey at least one attribute of the fuel in the underground fuel tank. As non-limiting examples, the attribute may indicate the fuel type, an octane rating, or a fuel blend. The underground fuel tank indicator flag may be resilient such that a vehicle could drive over the stanchion and the stanchion will restore itself to a vertical orientation when the vehicle is moved off of the underground fuel tank indicator flag. In some embodiments, the underground fuel tank indicator flag may utilize multiple colors on the flag and/or a second flag.

An object of the invention is to mark the location of a filler port for an underground fuel tank.

Another object of the invention is to convey an attribute of the fuel stored in the underground fuel tank.

A further object of the invention is to flex to a horizontal orientation when driven over to prevent damage to the invention.

Yet another object of the invention is to restore the invention to a vertical orientation when the weight of a vehicle is removed.

These together with additional objects, features and advantages of the underground fuel tank indicator flag will be readily apparent to those of ordinary skill in the art upon reading the following detailed description of the presently preferred, but nonetheless illustrative, embodiments when taken in conjunction with the accompanying drawings.

In this respect, before explaining the current embodiments of the underground fuel tank indicator flag in detail, it is to be understood that the underground fuel tank indicator flag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the underground fuel tank indicator flag.

It is therefore important that the claims be regarded as including such equivalent construction insofar as they do not depart from the spirit and scope of the underground fuel tank indicator flag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
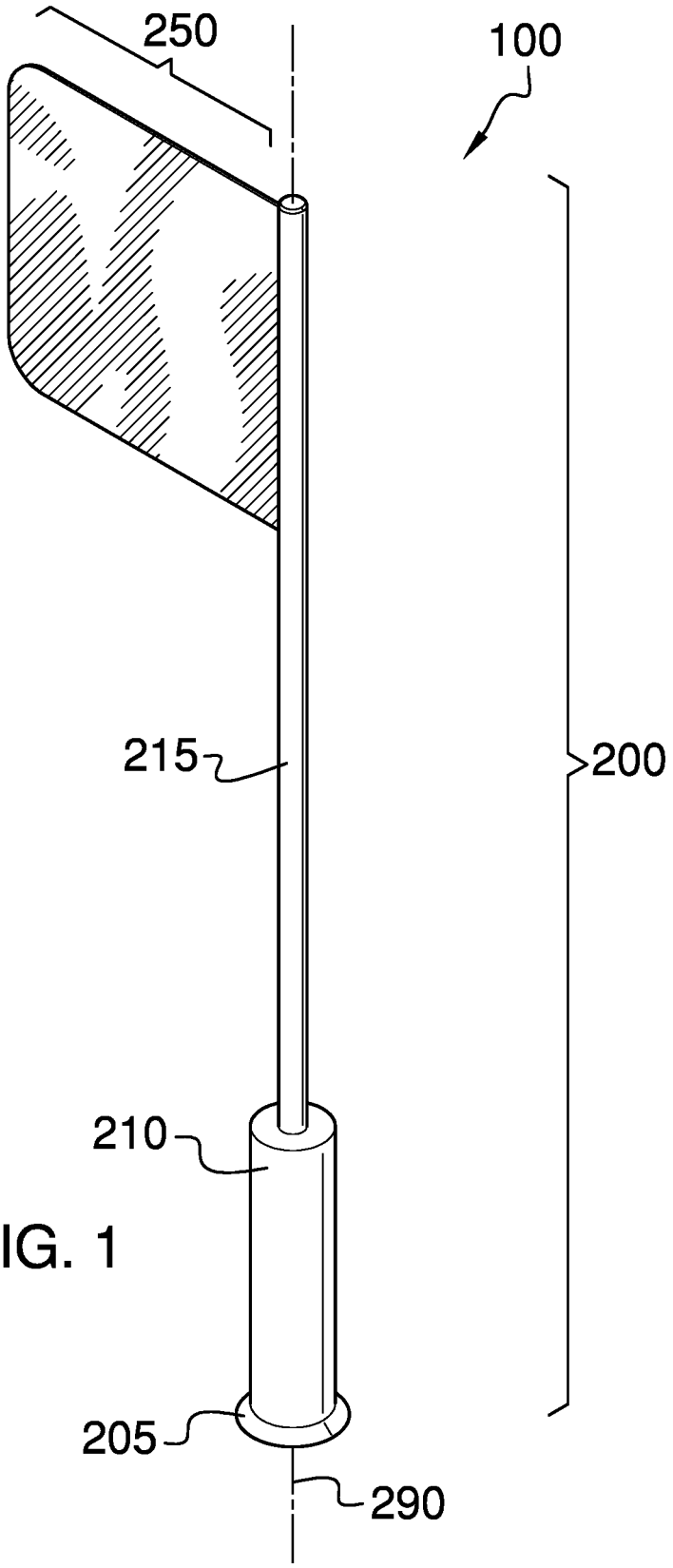
FIG. 1 is a perspective view of an embodiment of the disclosure.
Figure 2:
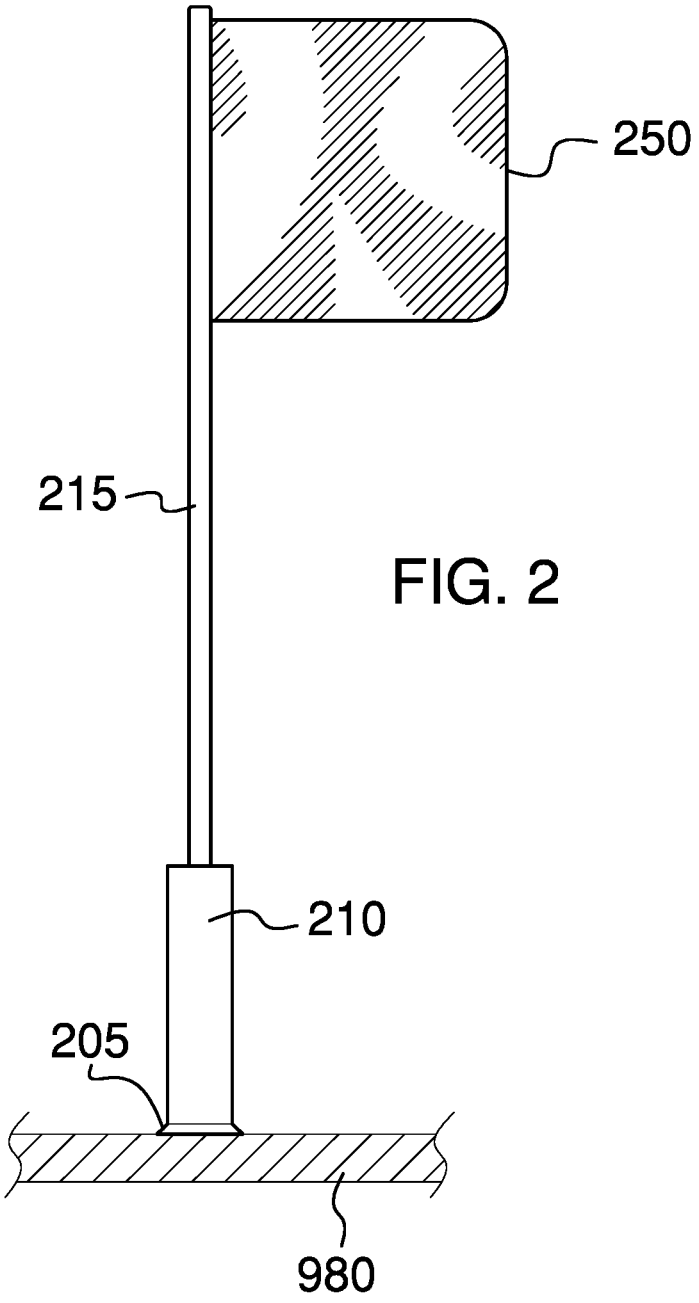
FIG. 2 is a side view of an embodiment of the disclosure.
Figure 3:
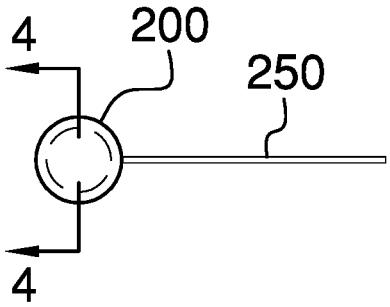
FIG. 3 is a bottom view of an embodiment of the disclosure.
Figure 4:
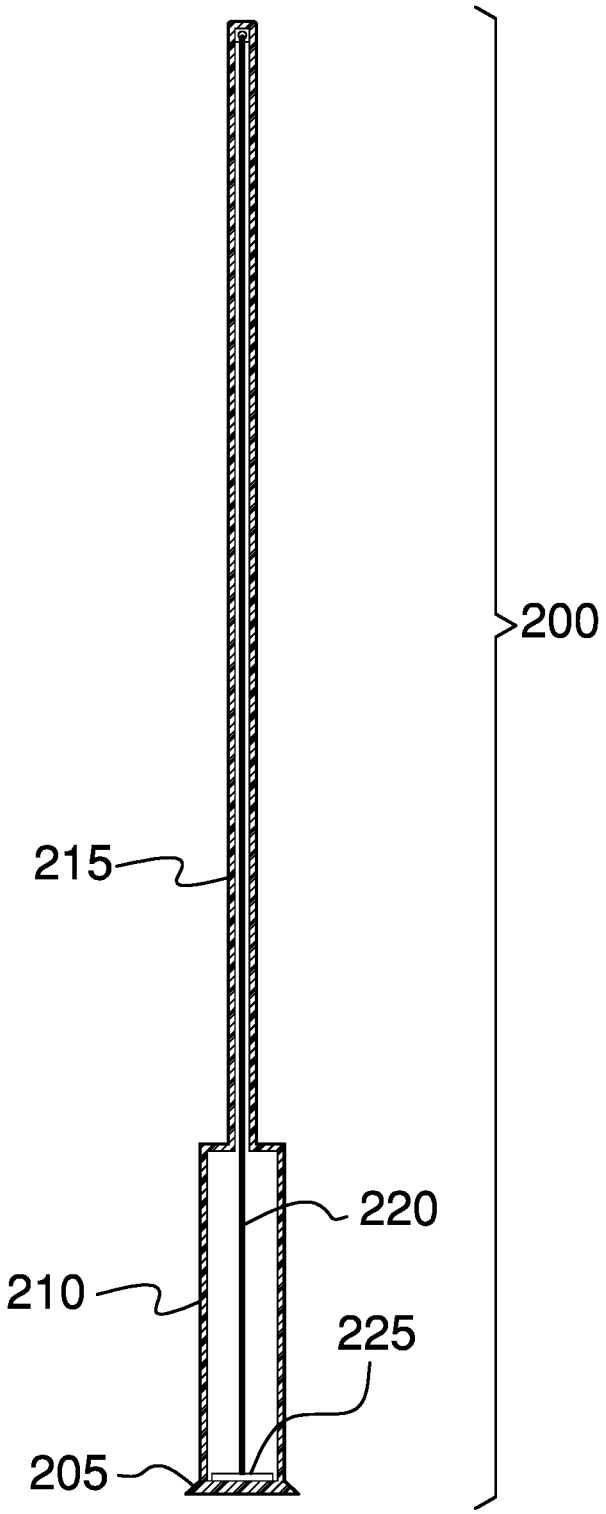
FIG. 4 is a cross-sectional view of an embodiment of the disclosure across 4-4 as shown in FIG. 3.
Figure 5:
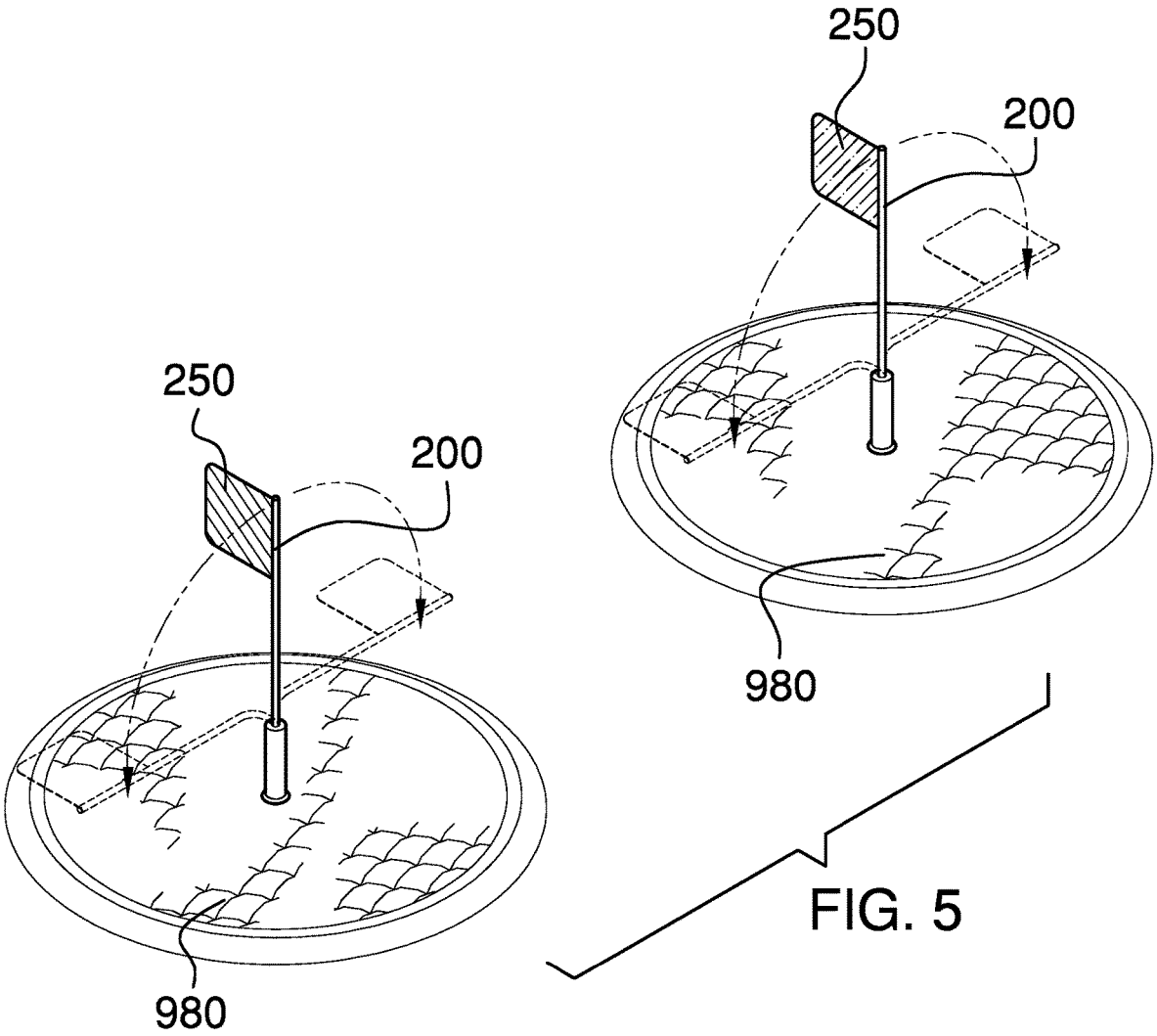
FIG. 5 is a detail view of an embodiment of the disclosure illustrating two underground fuel tank indicator flags attached to bases above two filler ports.
Figure 6:
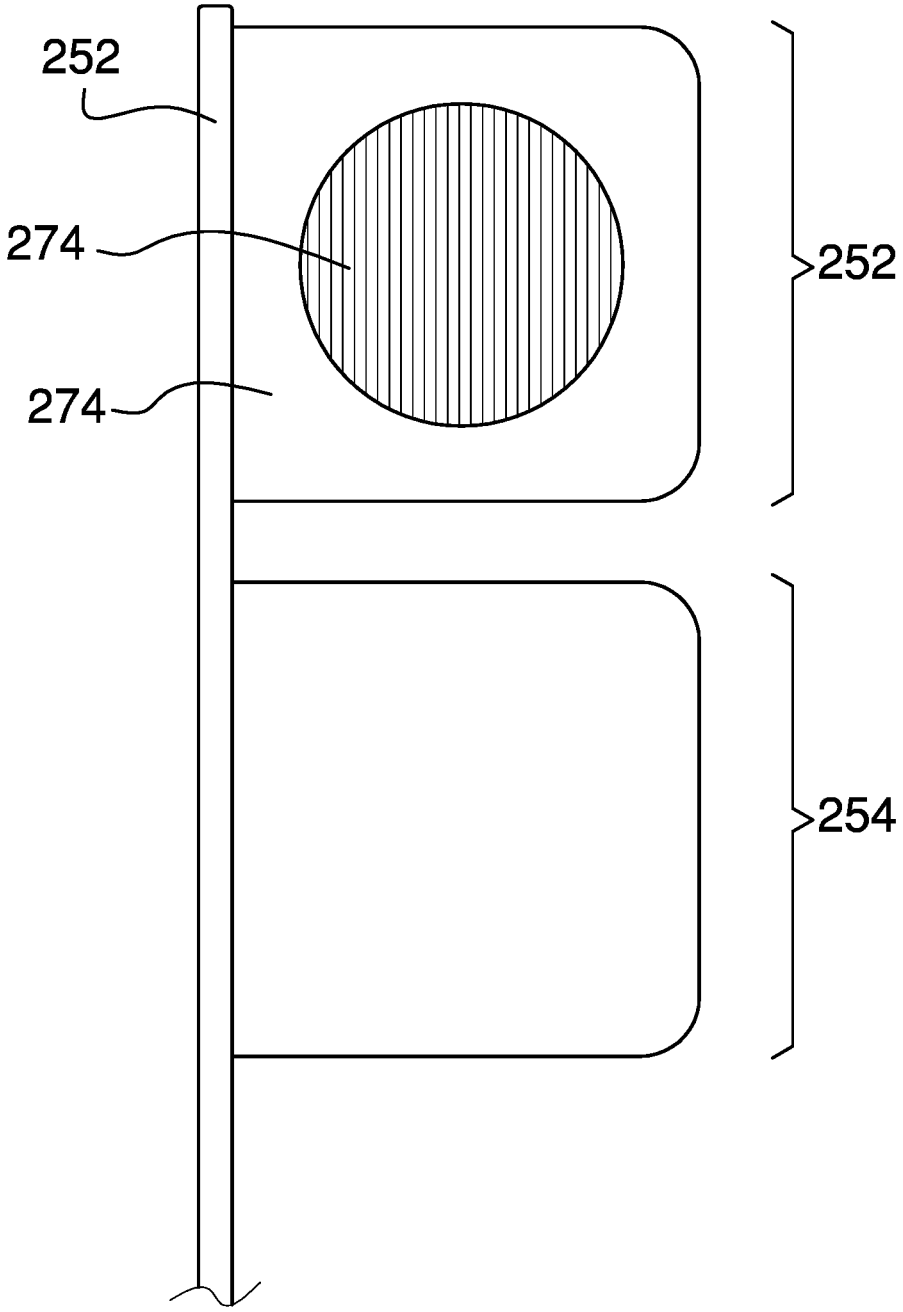
FIG. 6 is a detail view of an alternative embodiment of the disclosure illustrating the use of more than one color on a flag and the use of two flags.

Detailed reference will now be made to a first potential embodiment of the disclosure, which is illustrated in FIGS. 1 through 6.

The underground fuel tank indicator flag 100 (hereinafter invention) comprises a stanchion 200 and a flag 250. The invention 100 may mark the location of a filler port where a tanker truck would couple to an underground fuel tank to add fuel to the underground fuel tank. The invention 100 may be resilient such that a vehicle could drive over the stanchion 200, moving the stanchion 200 to a horizontal orientation, and the stanchion 200 will restore itself to an upright position. The invention 100 may convey an attribute of the fuel in the underground fuel tank. As non-limiting examples, the attribute may indicate the fuel type, an octane rating, or a fuel blend.

The stanchion 200 may comprise a lower stanchion portion 210, an upper stanchion portion 215, a flange 205, a wire 220, and a washer 225. The bottom of the stanchion 200 may be attached to a base 980. As non-limiting examples, the base 980 may be a cap for the filler port, another part of the underground fuel tank, a removable cover over the filler port, of the ground adjacent to the filler port, including the tarmac adjacent to the filler port. The stanchion 200 may hold the flag 250 above the ground.

The lower stanchion portion 210 may be a subdivision of the stanchion 200 located between the flange 205 and the upper stanchion portion 215. The lower stanchion portion 210 may be a cylindrical shape and may be oriented along a vertically-oriented central axis 290. The lower stanchion portion 210 may have a narrower diameter than the flange 205 and a larger diameter than the upper stanchion portion 215. The lower stanchion portion 210 may increase the stability of the stanchion 200.

The upper stanchion portion 215 may be a subdivision of the stanchion 200 located above the lower stanchion portion 210. The upper stanchion portion 215 provides elevation for the flag 250. The upper stanchion portion 215 may be a cylindrical shape aligned along the vertically-oriented central axis 290. The vertically-oriented central axis 290 passing through the upper stanchion portion 215 and the vertically-oriented central axis 290 passing through the lower stanchion portion 210 may be the same. The stanchion 200 may be made of a resilient material.

In some embodiments, the lower stanchion portion 210 may be 3+/−1 inches tall with a diameter of ¾+/−⅛ inch, the flange 205 may have a diameter of 1+/−⅛ inch, the upper stanchion portion 215 may have a diameter of ¼+/−⅛ inch, and a length of 7+/−1 inches.

The flange 205 is a widening at the bottom of the stanchion 200 that increases stability of the stanchion 200. The flange 205 may increase the surface area available to attach the stanchion 200 to the base 980.

The wire 220 may assist in returning the stanchion 200 to an upright position if the stanchion 200 is pushed towards horizontal. The wire 220 may be oriented centrally within the stanchion 200 and may be oriented vertically. The top of the wire 220 may be coupled to the top of the stanchion 200. The bottom of the wire 220 may be coupled to the bottom of the stanchion 200.

The washer 225 may stiffen the bottom of the stanchion 200. The washer 225 may be an annular metal disk that is horizontally oriented. The washer 225 may be located above and adjacent to the flange 205.

The flag 250 may be a color-coded indicator adapted to inform a driver of the tanker truck regarding the fuel stored in the underground fuel tank. One edge of the flag 250 may be coupled to the upper stanchion portion 215. The flag 250 may be rectangular in shape and may be made from a resilient material. As a non-limiting example, the color of the flag 250 may indicate the fuel type stored in the underground fuel tank.

In some embodiments, the flag 250 may be 3½+/−½ inch high by 3½+/−½ inch wide.

In some embodiments, the flag 250 may comprise a plurality of colors that convey a plurality of attributes of the fuel. The specific colors, the number of color regions, the shape of color regions, placement of color regions, or combinations thereof may convey the plurality of attributes of the fuel. As a non-limiting example, a diamond-shaped region of a first color section 272 may convey the fuel type and a background of a second color section 274 may convey the octane rating.

In some embodiments, the invention 100 may comprise a plurality of flags. Each of the plurality of flags may be coupled to the upper stanchion portion 215. Each of the plurality of flags may convey a specific attribute. As a non-limiting example, a first flag 252 may be located at the top of the stanchion 200 and may convey a first attribute and a second flag 254 located beneath the first flag 252 may convey a second attribute.

In use, the invention 100 is coupled to the base 980 adjacent to the filler port of the underground fuel tank. As a non-limiting example, the invention 100 may be coupled to the base 980 using an adhesive. The flag 250 or the plurality of flags are selected such that the specific colors, the number of color regions, the shape of color regions, the placement of color regions, or combinations thereof convey the plurality of attributes regarding the fuel that is to be stored in the underground fuel tank. As the driver approaches the filler port with the tanker truck, the driver can verify that the filler port is correct for the delivery that the tanker truck is making. If the invention 100 is run over, the vehicle that ran over it may force the stanchion 200 into a horizontal orientation. When the vehicle has driven off the invention 100, the stanchion 200 may restore itself to a vertical orientation where the flag 250 or the flags 250 are visible.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "elevation" refers to the span of the distance between a horizontal surface and a support surface as measured in the direction opposite to the force of gravity.

As used in this disclosure, a "flag" is a textile or sheeting material that attached by one edge to a pole or a rope. In general usage, a flag will display an image that often contains some form of symbolic meaning or message. This definition maps to the common patent classification definitions and is therefore explicitly intended to include flag like objects commonly referred to as a "banner".

As used in this disclosure, a "flange" is a protruding rib, edge, or collar that is used to hold an object in place or to attach a first object to a second object.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, "orientation" refers to the positioning and/or angular alignment of a first object relative to a second object or relative to a reference position or reference direction.

As used in this disclosure, "resilient" or "semi-rigid" refer to an object or material which will deform when a force is applied to it and which will return to its original shape when the deforming force is removed.

As used in this disclosure, a "stanchion" refers to a vertical pole, post, or support.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An underground fuel tank indicator flag comprising:

a stanchion and a flag;

wherein the underground fuel tank indicator flag marks the location of a filler port where a tanker truck would couple to an underground fuel tank to add fuel to the underground fuel tank;

wherein the underground fuel tank indicator flag is resilient such that a vehicle could drive over the stanchion, moving the stanchion to a horizontal orientation, and the stanchion will restore itself to an upright position;

wherein the underground fuel tank indicator flag conveys an attribute of the fuel in the underground fuel tank;

wherein the stanchion comprises a lower stanchion portion, an upper stanchion portion, a flange, a wire, and a washer;

wherein the bottom of the stanchion is attached to a base;

wherein the stanchion holds the flag above ground;

wherein the flag is a color-coded indicator adapted to inform a driver of the tanker truck regarding the fuel stored in the underground fuel tank;

wherein one edge of the flag is coupled to the upper stanchion portion;

wherein the flag is rectangular in shape and is made from a resilient material.

2. The underground fuel tank indicator flag according to claim 1 wherein the lower stanchion portion is a subdivision of the stanchion located between the flange and the upper stanchion portion;

wherein the lower stanchion portion is a cylindrical shape and is oriented along a vertically-oriented central axis.

3. The underground fuel tank indicator flag according to claim 2 wherein the lower stanchion portion has a narrower diameter than the flange and a larger diameter than the upper stanchion portion;

wherein the lower stanchion portion increases the stability of the stanchion.

4. The underground fuel tank indicator flag according to claim 3 wherein the upper stanchion portion is a subdivision of the stanchion located above the lower stanchion portion;

wherein the upper stanchion portion provides elevation for the flag;

wherein the upper stanchion portion is a cylindrical shape aligned along the vertically-oriented central axis.

5. The underground fuel tank indicator flag according to claim 4 wherein the vertically-oriented central axis passing through the upper stanchion portion and the vertically-oriented central axis passing through the lower stanchion portion are the same.

6. The underground fuel tank indicator flag according to claim 5 wherein the stanchion is made of a resilient material.

7. The underground fuel tank indicator flag according to claim 6 wherein the lower stanchion portion is 3+/−1 inches tall with a diameter of ¾+/−⅛ inch, the flange has a diameter of 1+/−⅛ inch, the upper stanchion portion has a diameter of ¼+/−⅛ inch, and a length of 7+/−1 inches.

8. The underground fuel tank indicator flag according to claim 7 wherein the flange is a widening at the bottom of the stanchion that increases stability of the stanchion;

wherein the flange increases the surface area available to attach the stanchion to the base.

9. The underground fuel tank indicator flag according to claim 8 wherein the wire assists in returning the stanchion to an upright position if the stanchion is pushed towards horizontal.

10. The underground fuel tank indicator flag according to claim 9 wherein the wire is oriented centrally within the stanchion and is oriented vertically;

wherein the top of the wire is coupled to the top of the stanchion;

wherein the bottom of the wire is coupled to the bottom of the stanchion.

11. The underground fuel tank indicator flag according to claim 10 wherein the washer stiffens the bottom of the stanchion;

wherein the washer is an annular metal disk that is horizontally oriented.

12. The underground fuel tank indicator flag according to claim 11 wherein the flag is 3½+/−½ inch high by 3½+/−½ inch wide.

13. The underground fuel tank indicator flag according to claim 12 wherein the flag comprises a plurality of colors that convey a plurality of attributes of the fuel;

wherein the specific colors, the number of color regions, the shape of color regions, placement of color regions, or combinations thereof convey the plurality of attributes of the fuel.

14. The underground fuel tank indicator flag according to claim 13 wherein the underground fuel tank indicator flag comprises a plurality of flags;

wherein each of the plurality of flags are coupled to the upper stanchion portion;

wherein each of the plurality of flags convey a specific attribute.

15. The underground fuel tank indicator flag according to claim 14 wherein a first flag is located at the top of the stanchion and conveys a first attribute and a second flag located beneath the first flag conveys a second attribute.

* * * * *